US007393316B2

(12) United States Patent
Behmel et al.

(10) Patent No.: US 7,393,316 B2
(45) Date of Patent: Jul. 1, 2008

(54) LONGITUDINAL FOLDING APPARATUS

(75) Inventors: Johannes Behmel, Plauen (DE); Ulrich Seyffert, Syrau (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/260,905

(22) Filed: Oct. 28, 2005

(65) Prior Publication Data

US 2006/0111227 A1 May 25, 2006

(30) Foreign Application Priority Data

Oct. 30, 2004 (DE) ..... 10 2004 052 714

(51) Int. Cl.
*B31F 1/10* (2006.01)
*B31F 1/08* (2006.01)

(52) U.S. Cl. ..... 493/439; 493/438

(58) Field of Classification Search ..... 493/413, 493/424, 434, 476, 435, 442
See application file for complete search history.

(56) References Cited

U.S. PATENT DOCUMENTS 686,573 A * 11/1901 Bechman ..... 493/435
1,770,350 A * 7/1930 Jordhoy ..... 493/435
4,726,578 A * 2/1988 Hickman et al. ..... 270/42
6,024,684 A * 2/2000 Maylander et al. ..... 493/346
6,712,749 B1 * 3/2004 Michalik et al. ..... 493/424

FOREIGN PATENT DOCUMENTS

| | | |
|---|---|---|
| DE | 196 02 248 | 7/1997 |
| DE | 197 50 555 | 5/1999 |
| WO | WO 97/17200 | 5/1997 |

* cited by examiner

*Primary Examiner*—Rinaldi I. Rada
*Assistant Examiner*—Lindsay Low
(74) *Attorney, Agent, or Firm*—Cohen Pontani Lieberman & Pavane LLP

(57) ABSTRACT

A longitudinal folding apparatus for webs on a folder of a rotary press includes a variable-position folding former arranged behind a former roll and ahead of folding rolls in the web running direction, it being possible to adjust the folding former approximately in parallel in the direction of longitudinal axes of the folding rolls. The folding former is connected in a hinged fashion to levers which are mounted pivotably in the frame, the levers being drive-connected to one another.

10 Claims, 4 Drawing Sheets

LONGITUDINAL FOLDING APPARATUS

BACKGROUND OF THE INVENTION

The present invention relates to a longitudinal folding apparatus for webs on a folder of a rotary press, having a variable-position folding former.

DE 196 02 248 A1 discloses a longitudinal folding apparatus of a rotary press, having a folding former which is arranged behind a former roll and ahead of folding rolls in the web running direction. The folding former can be adjusted in parallel in the axial direction of the folding rolls. For this purpose, it is attached in a hinged fashion to thee threaded spindles which are mounted in the frame. The adjustment is carried out by rotation of the threaded spindles which are synchronized by means of a chain drive. The former roll is mounted in the frame. A round body ensures that the web is fed in the plane which includes the web bearing face of the folding former.

It is a disadvantage of this apparatus that the adjusting apparatus for the folding former is expensive. Moreover, the lowermost web can slip on the round body as a consequence of friction or the print can smear with the consequence of quality losses for the printed product.

SUMMARY OF THE INVENTION

An object of the present invention is to provide a folding apparatus in which the folding former is adjustable with inexpensive means in the axial direction of the folding rolls.

The object is met by a longitudinal folding apparatus for webs on a folder of a rotary press having a variable-position folding former arranged behind a former roll and ahead of folding rolls in the web running direction, it being possible to adjust the folding former approximately in parallel in the direction of longitudinal axes of the folding rolls. The folding former is connected in a hinged fashion to levers which are mounted pivotably in the frame, the levers being drive-connected to one another. The apparatus according to the present invention is distinguished by a structurally simple construction, is space-saving and can be set up inexpensively. The folding former can be adjusted satisfactorily by small amounts and the stream inlet into the folding unit can be optimized in the process. The drive connection of the levers allows the levers to be driven in a coordinated manner with respect to one another. This permits movement of points of the levers having identical travel components in the axial direction of the folding rolls. The corresponding parallel adjustment of the folding former is made possible if the said folding former is attached in a hinged fashion at these points. The direction of the longitudinal axes of the folding rolls is viewed in their parallel arrangement, that is to say without any inward movements being taken into consideration.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
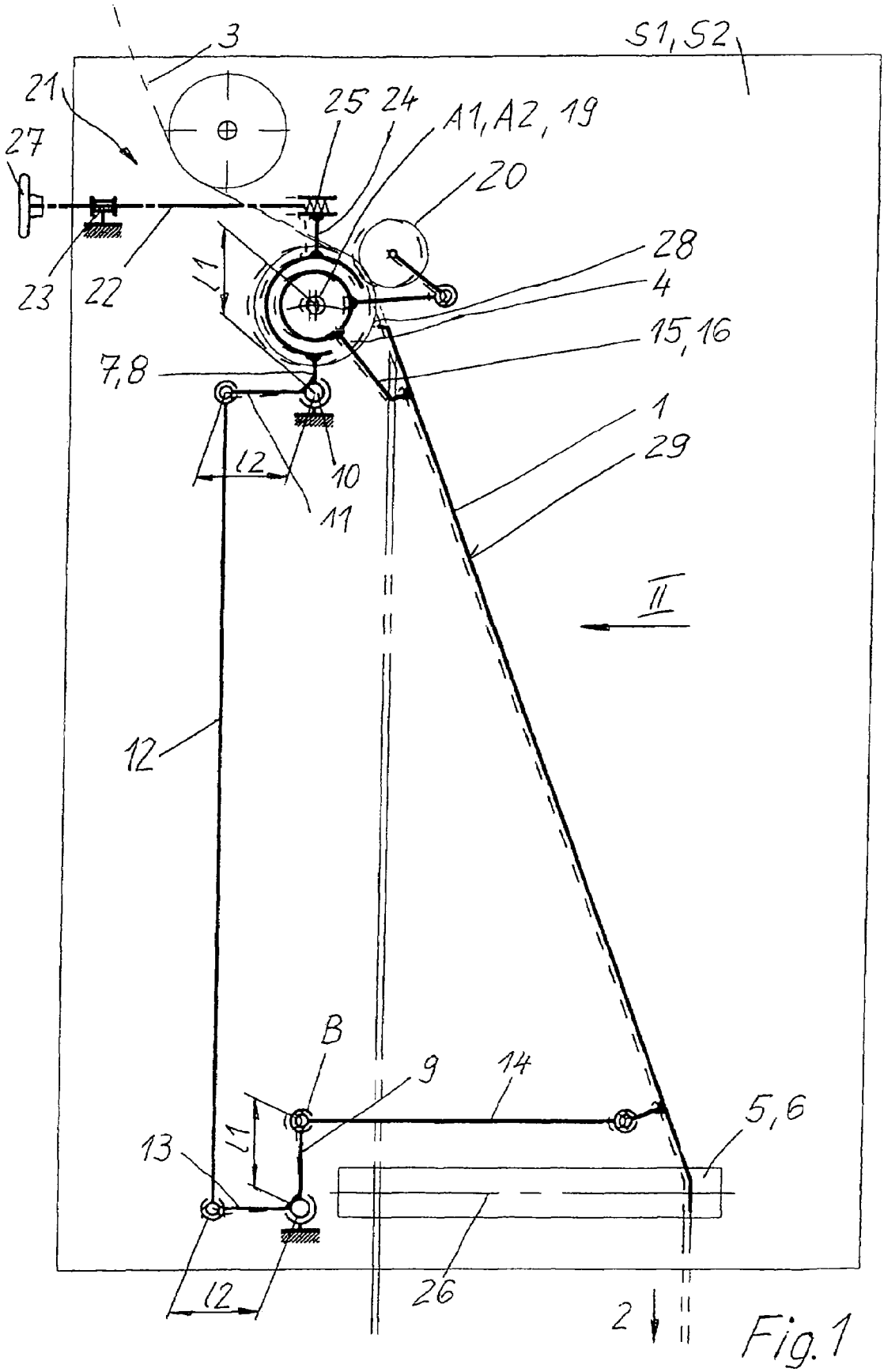
FIG. 1 is a schematic side view of a longitudinal folding apparatus according to the present invention.

The longitudinal folding apparatus shown in FIG. 1 comprises a folding former 1 which is arranged behind a former roll 4 and ahead of folding rolls 5, 6 in the web running direction 2 of a web 3.

Figure 2:
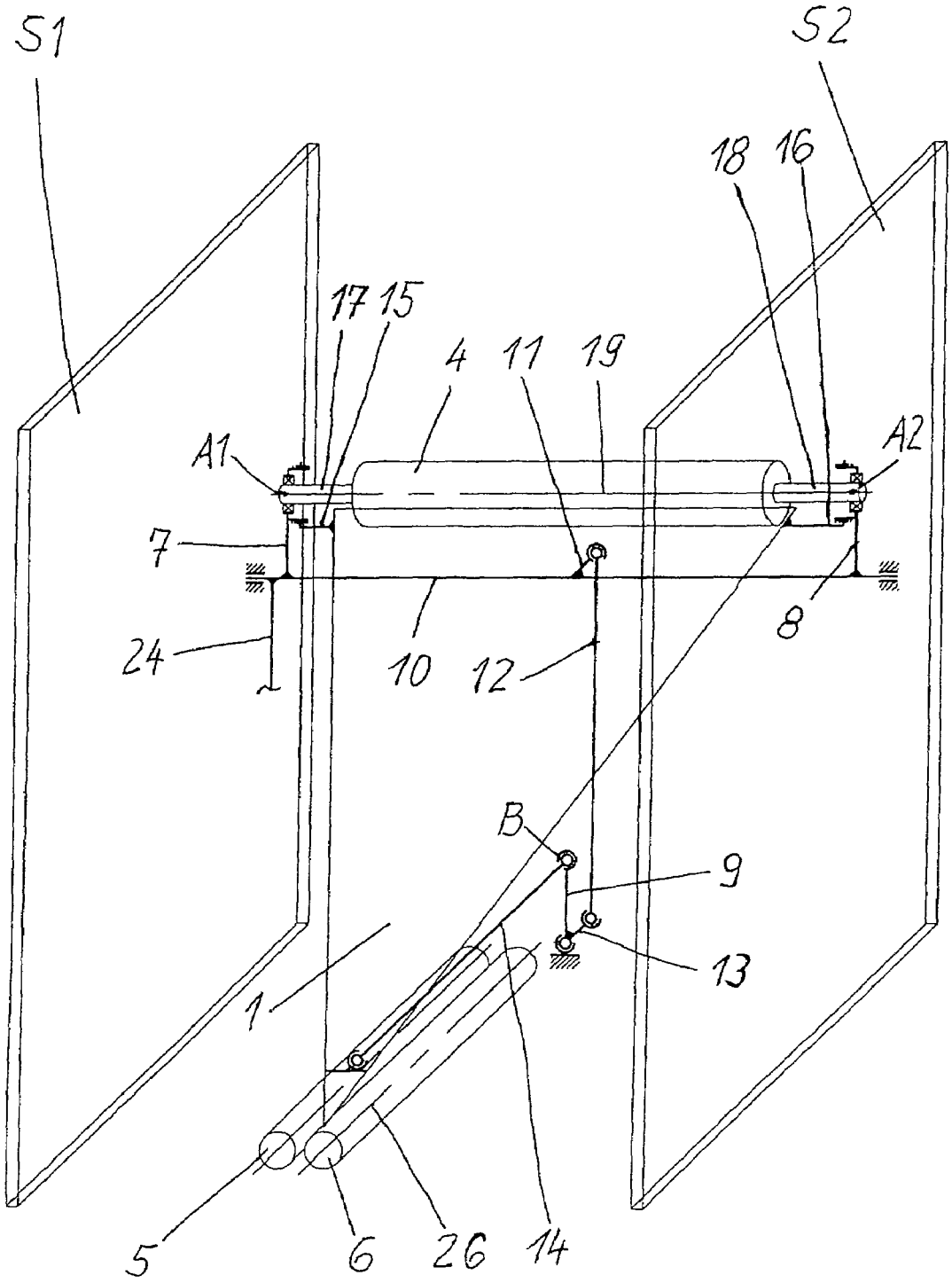
FIG. 2 is a schematic perspective view of the longitudinal folding apparatus of FIG. 1 from the direction indicated by arrow 11 in FIG. 1.

The folding former 1 is connected in a hinged fashion to a plurality of levers which are mounted pivotably In the frame of the longitudinal folding apparatus. Two upper levers 7, 8 are articulated on an upper region of the folding former 1, and one lower lever 9 is articulated on a lower regions of the folding former 1 (FIG. 2). The two upper levers 7, 8 are connected fixedly to one another in terms of rotation. In the embodiment shown in FIG. 1, the two upper levers 7, 8 are fastened to a shaft 10 which is mounted in side walls S1 and S2.

The upper levers 7 and 8 and the lower lever 9 are drive-connected to one another. For this purpose, a crank 11 is fastened to the shaft 10, on which crank 11 a coupler 12 is articulated which is connected in a hinged fashion to a swinging arm 13 which is connected fixedly to the lower lever 9. A rod 14 which is connected in a hinged fashion to the folding former 1 is articulated on the lever 9. The abovementioned hinged connection can also be of fixed configuration. The lower lever 9 and the swinging arm 13 are advantageously configured as angled levers. They can also be configured as individual levers and be fastened on a shaft spaced apart from one another, one of the upper levers 7, 8 and the crank 11 advantageously being configured as angled levers.

The folding former 1 is mounted with two holding devices 15, 16 fastened to it on the upper levers 7, 8 in the articulation points A1, A2 which have the spacing I1 from the pivot point of the upper levers 7, 8. The former roll 4 is mounted rotatably with its journals 17, 18 in the upper levers 7, 8 coaxially with respect to an axis 19 via the articulation points A1 and A2. The former roll 4 is mounted indirectly on the folding former 1 by the articulation of the former roll 4 on the upper levers 7, 8 in the articulation points A1, A2. Further functional elements, for example a slitter 20 or a press roller, can be arranged on the holding devices 15, 16.

The levers 7 to 9 are drive-connected to an adjusting unit 21. The adjusting unit 21 comprises a drive shaft 22 which is supported pivotably in an axially non-displaceable manner in a bearing 23 which is arranged in the frame, for example in the side wall S1. At the other end, the drive shaft 22 bears a thread, with which it is screwed into a spindle nut 25 which is mounted pivotably in a lever 24. The lever 24 is fastened to the shaft 10. However, the adjusting unit 21 could also act, for example, on one of the upper levers 7, 8 or on the lower lever 9, the crank 11, the coupler 12, the swinging arm 13 or the folding former 1.

A web 3 which is fed to the longitudinal folding apparatus, or webs or web streams, is/are guided via the former roll 4 to the folding former 1 and, in the further course, folded longitudinally and guided through the nip between the folding rolls 5, 6. The folding former 1 can be adjusted in parallel to the direction of the longitudinal axes 26 of the folding rolls 5, 6 by actuation of the adjusting unit 21. The lever 24 is pivoted into the position shown by dashed lines by rotation of the handwheel 27 which is attached to the drive shaft 22. The upper levers 7, 8 and the crank 11 are pivoted into the dashed positions with the pivoting movement which takes place in the process. Furthermore, the swinging arm 13 and the lower lever 9 are pivoted into the dashed positions by the connection to the coupler 12. The crank 11, the coupler 12 and the swinging arm 13 are designed as a parallel crank mechanism, the crank 11 and the swinging arm 13 being of the same length 12 and always lying parallel to one another. Accordingly, identical pivoting angles are assigned to the upper levers 7, 8 and the lower lever 9 in response to the rotation of the handwheel 27. In a parallel alignment of these levers 7 to 9, the articulation points A1, A2 of the upper levers 7, 8 and the articulation point B of the lower lever 9, which, like the articulation points A1 and A2, has the same spacing I1 from the pivot point of the lower lever 9, then perform pivoting movements which have identical travel components in the direction of the longitudinal axes 26 of the folding rolls 5, 6. The folding former 1 thus performs a corresponding parallel movement in this direction. The pivoting movements of the levers 7 to 9 are also given a movement component perpendicularly with respect to the longitudinal axes 26 of the folding rolls 5, 6. This vertical component is kept so small that the corresponding vertical movement of the folding former 1 does not have a negative effect on the web entry into the nip between the folding rolls 5, 6. In the embodiment of FIG. 1, the spacing I1 is approximately 180 mm, a satisfactory ratio resulting from this between the required adjusting travel in the direction of the longitudinal axes 26 of the folding rolls 5, 6 and the vertical movement which takes place in the process.

The adjusting unit 21 can alternatively be actuated with a motor, instead of manually. Instead of the above-described spindle drive, other adjusting mechanisms may also be used.

When the folding former 1 is adjusted, the former roll 4 is guided with it as a result of it being mounted on the folding former 1. It is advantageously arranged such that a cover 28 of the former roll 4 is tangent on the plane which includes the web bearing face 29 of the folding former 1. As a result, low-friction entry of the web 3 onto the folding former 1 is ensured, which counteracts smearing of the print. The risk is also low as a result of the fact that the lowermost web of an incoming stream is displaced with respect to the webs which lie above it. Preconditions for satisfactory print quality are thus provided. These conditions still exist after the folding former 1 has been adjusted. The above-described mounting of the former roll 4 may also be used in other adjustment processes of the folding former which are not described in the present application.

Figure 3:
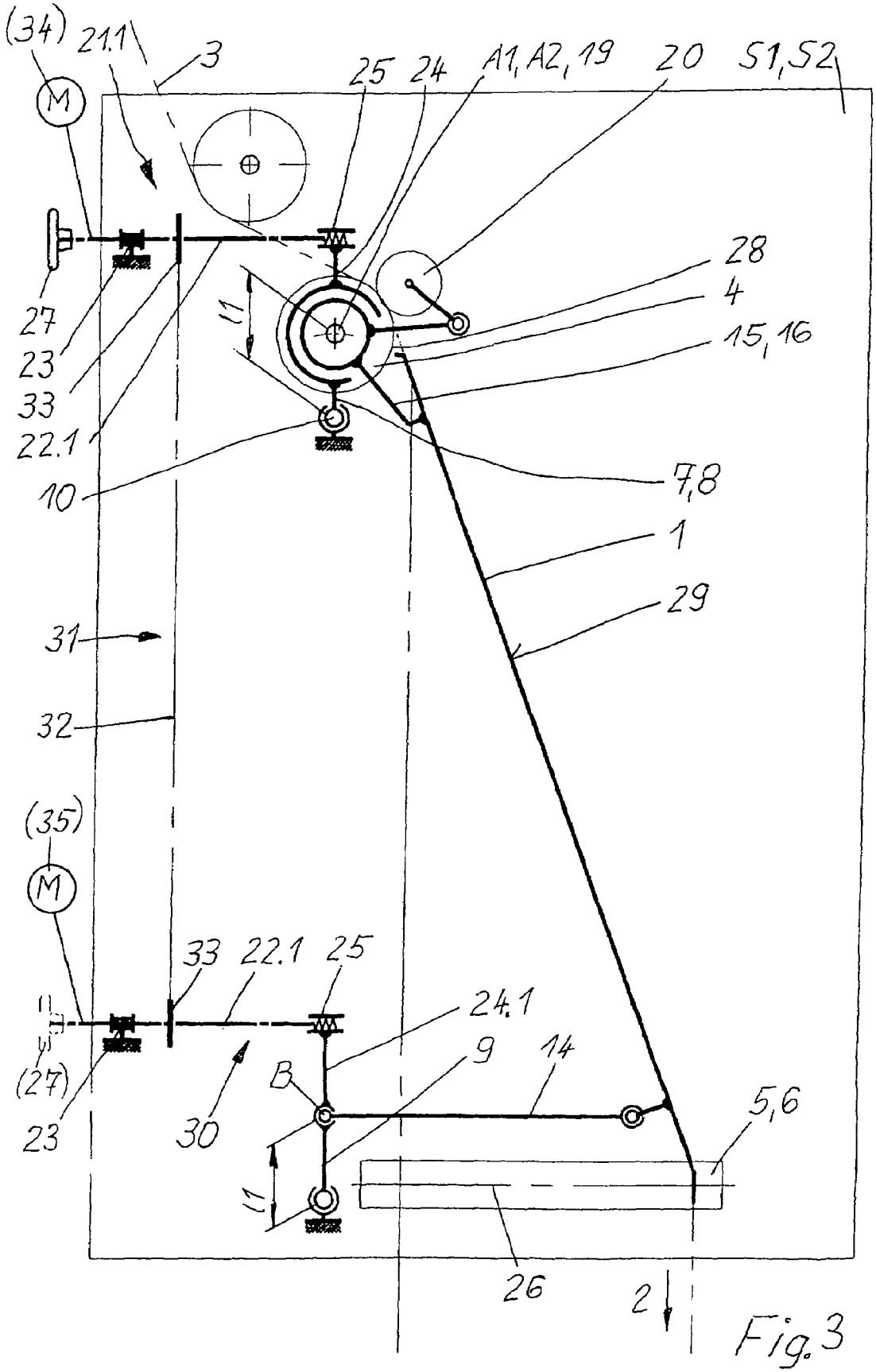
FIG. 3 is a schematic side view of a further embodiment of the longitidunal folding apparatus.

In the following embodiments of FIGS. 3 and 4, the previous reference numerals are retained for re-appearing identical or equivalent components for the sake of simplicity. In some cases, a suffix "0.1" or "0.2" is added to indicate that a component is different from the similar component in FIG. 1. The longitudinal folding apparatus shown in FIG. 3 is partially identical to that shown in FIG. 1. Detailed descriptions of the similar components are not required and are therefore excluded in the interest of brevity. The longitudinal folding device of FIG. 3 comprises a folding former 1 which is arranged behind a former roll 4 and ahead of folding rolls 5, 6 in the web running direction 2 of a web 3. The folding former 1 is connected in a hinged fashion to upper levers 7, 8 which are mounted pivotably in the frame and to a lower lever 9. A shaft 10 which is mounted in side walls S1 and S2, a rod 14, holding devices 15, 16, an axis 19 and a slitter 20 are used, as shown in FIG. 1. Furthermore, two similar adjusting units 21.1 and 30 are provided. Each adjusting unit 21.1, 30 comprises a drive shaft 22.1 which is supported pivotably in a bearing 23 which is fastened to the frame. The drive shaft 22.1 of adjusting unit 21.1 is threaded into a spindle nut 25 which is mounted in a hinged fashion in a lever 24 which is connected to the upper levers 7 and 8. The drive shaft 22.1 of the adjusting unit 30 is threaded into a spindle nut 25 which is mounted in a hinged fashion in a lever 24.1 which is connected fixedly to the lower lever 9.

The drive shaft 22.1 of the adjusting unit 21.1 bears a handwheel 27, with which the drive shaft 22.1 is rotated for adjustment of the folding former 1. This rotational movement is transmitted synchronously, with the aid of an external flexible drive 31, to the drive shaft 22.1 of the adjusting unit 30. The external flexible drive 31 is realized, for example, with a toothed belt 32 which runs on in each case one pulley wheel 33 which is fastened to the drive shafts 22.1. The handwheel 27 may alternatively be arranged on the drive shaft 22.1 of the adjusting unit 30. This variant is also shown in FIG. 3 using dashed lines. The upper levers 7, 8 and the lower lever 9 are drive-connected to one another via the external flexible drive 31 of the adjusting units 21.1 and 30, and can be driven in a manner which is coordinated with one another, in this case synchronously. The coordinated drive can also be effected without the external flexible drive 31, in such a way that the drive shafts 22.1 of the adjusting units 21.1 and 30 are driven by in each case one electric motor 34, 35. The electric motors 34 and 35 are drive-connected via a controller and are operated synchronously. This variant of the drive of the adjusting units 21.1 and 30 is also specified in FIG. 3 with reference numerals placed in brackets. The folding former 1 is adjusted when the adjusting units 21.1 and 30 are actuated in the direction of the longitudinal axes 26 of the folding rolls 5, 6, as described in relation to FIG. 1. During non-synchronous operation of the electric motors 34 and 35, for example when only one electric motor 34, 35 is operated, the angular position of the plane which includes the web bearing face 29 of the folding former 1 can be adjusted. Further explanations with respect to an adjustment of this type of the folder plane will be made in the following embodiment.

Figure 4:
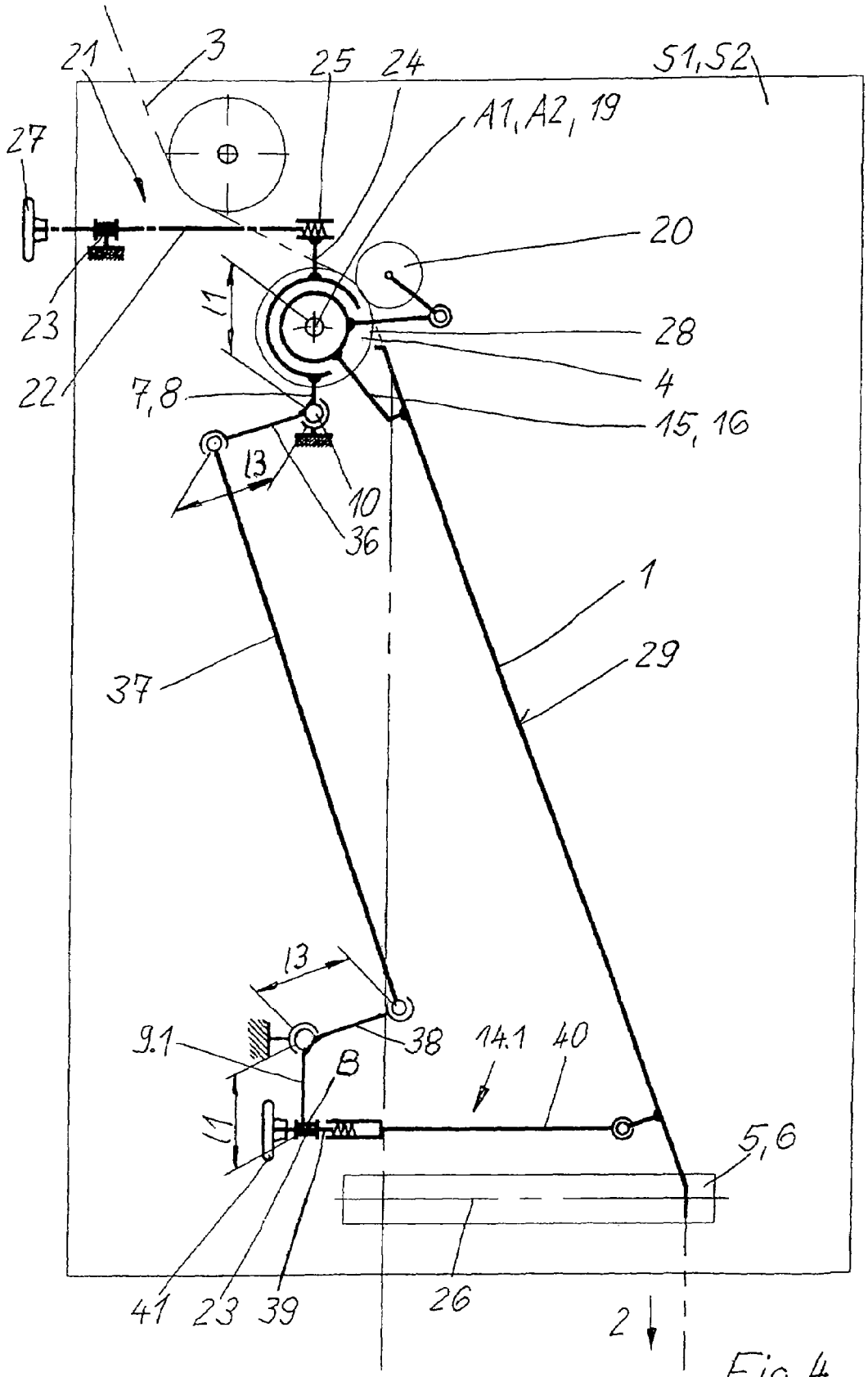
FIG. 4 is a schematic side view of a further embodiment of the longitudinal folding apparatus, which design variant moreover comprises an apparatus for adjusting the angular position of the former plane.

The longitudinal folding apparatus shown in FIG. 4 comprises a folding former 1 which is arranged behind a former roll 4 and ahead of folding rolls 5, 6 in the web running direction 2 of a web 3. Upper levers 7, 8 and a lower lever 9.1 are mounted pivotably in the frame and connected in a hinged fashion to the folding former 1. For this purpose, in an analogous manner to the apparatus according to FIG. 1, holding devices 15, 16 are fastened to the folding former 1 which are articulated in the articulation points A1 and A2 on the upper levers 7, 8. The arrangement of a slitter 20, the mounting of the former roll 4 on the folding former 1 and the attachment of an adjusting unit 21 to the upper levers 7, 8 are also analogous to FIG. 1. Accordingly, the adjusting unit 21 comprises a drive shaft 22 which is supported pivotably in a bearing 23 arranged on the frame and bears a handwheel 27. Furthermore, the drive shaft 22 is screwed with a threaded piece into a spindle nut 25 which is mounted pivotably in a lever 24 which, like the upper levers 7 and 8, is fastened to a shaft 10 which is mounted in side walls S1 and S2. Furthermore, a coupler 37 is articulated on a crank 36 which is fastened to the shaft 10. The coupler 37 is connected in a hinged fashion to a swinging arm 38 which is connected fixedly to the lever 9.1. The swinging arm 38 and the lower lever 9.1 advantageously form an angled lever.

An adjustable-length rod 14.1 is articulated on the lower lever 9.1. The other end of the rod 14.1 is connected in a hinged fashion to the folding former 1. The rod 14.1 comprises a threaded spindle 39 and a rod part 40 having an internal thread, into which the threaded spindle 39 can be threaded. Furthermore, a handwheel 41 Is fastened to the threaded spindle 39.

For adjustment of the folding former 1, the drive shaft 22 of the adjusting unit 21 is rotated by means of the handwheel 27 and, depending on the rotational direction, is screwed into the spindle nut 25 or out of the latter. The lever 24 and the upper levers 7 and 8 are pivoted accordingly. The lower lever 9.1 is given an equally great pivoting movement by means of the crank 36, the coupler 37 and the swinging arm 38. For this purpose, the crank 36, the coupler 37 and the swinging arm 38 are designed as a parallel crank mechanism, in which the crank 36 and the swinging arm 38 are of the same lever length 13. The upper levers 7 and 8 and the lower lever 9.1 are positioned with respect to one another in such a way that their articulation points A1, A2, B are at the same spacing 11 from the pivot point and, with an identical pivoting angle, cover identical travel components in the direction of the longitudinal axes 26 of the folding rolls 5, 6. As a result, the folding former 1 is displaced approximately in parallel in the direction of the longitudinal axes 26 of the folding rolls 5, 6. The levers 7, 8 and 9.1 are dimensioned in such a way that a movement component of the folding former 1 which occurs perpendicularly with respect to the longitudinal axes 26 of the folding rolls 5, 6 is so small that the entry of the web 3 into the nip between the folding rolls 5, 6 is not influenced disadvantageously.

It is also possible to adjust the angular position of the plane which includes the web bearing face 29 of the folding former 1 by the adjustable-length rod 14.1. Precision correction of the web run can be performed by an angular change of this type to the former plane. For example, the smearing of the print and stream displacements can be restricted and the print quality thus increased by a web run which is set in an optimum manner. For this purpose, the threaded spindle 39 is screwed into the rod part 40 or out of it by rotation of the handwheel 41, and the rod 14.1 is shortened or lengthened in the process and the folding former 1 is thus pivoted about the articulation points A1, A2. The above-described adjusting device can be retrofitted into an existing folding apparatus with little expenditure.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A longitudinal folding apparatus for webs on a folder of a rotary press which receives the webs in a web running direction, comprising:

a frame;

a former roll, folding rolls having longitudinal axes, and a variable-position folding former, each being arranged in said frame, said variable-position folding former being arranged behind said former roll and ahead of said folding rolls in the web running direction;

levers mounted pivotably to said frame and being drive-connected to one another, said variable position folding former being hingably connected to said levers such that said variable position folding former is adjustable approximately in a direction parallel to said longitudinal axes of said folding rolls, wherein said levers comprise two upper levers and a lower lever, said two upper levers being connected fixedly to one another with respect to rotation and arranged at an upper region of said variable position folding former, and said lower lever being arranged at a lower region of said variable position folding former; and a shaft connected to said two upper levers, a crank connected to said shaft and to said two upper levers, a swinging arm connected fixedly to said lower lever, and a coupler hingably connected between said crank and said swinging arm.

2. The longitudinal folding apparatus of claim 1, further comprising an adjusting unit drive-connected to said levers, said levers being pivotable in response to said adjusting unit.

3. A longitudinal folding apparatus for webs on a folder of a rotary press which receives the webs in a web running direction, comprising:

a frame;

a former roll, folding rolls having longitudinal axes, and a variable-position former, each being arranged in said frame, said variable-position folding former being arranged behind said former roll and ahead of said folding rolls in the web running direction;

levers mounted pivotably to said frame and being drive-connected to one another, said folding former being hingably connected to said levers such that said folding former is adjustable approximately in a direction parallel to said longitudinal axes of said folding rolls, wherein said levers comprise two upper levers and a lower lever, said two upper levers being connected fixedly to one another with respect to rotation and arranged at an upper region of said folding former, and said lower lever being arranged at a lower region of said folding former; and an adjustable-length rod articulated on said variable position folding former and hingably connected to said lower lever.

4. A longitudinal folding apparatus for webs on a folder of a rotary press which receives the webs in a web running direction, comprising:

a frame;

a former roll, folding rolls having longitudinal axes, and a variable-position former, each being arranged in said frame, said variable-position folding former being arranged behind said former roll and ahead of said folding rolls in the web running direction; and levers mounted pivotably to said frame and being drive-connected to one another, said folding former being hingably connected to said levers such that said folding former is adjustable approximately in a direction parallel to said longitudinal axes of said folding rolls, wherein said levers comprise two upper levers and a lower lever, said two upper levers being connected fixedly to one another with respect to rotation and arranged at an upper region of said folding former, and said lower lever being arranged at a lower region of said folding former, and wherein said variable position folding former is articulated at articulation points on said upper levers, opposing ends of said former roll being mounted coaxially in said upper levers by said articulation points of said variable position folding former on said upper levers.

5. The longitudinal folding apparatus of claim 4, further comprising a first adjusting unit connected to said upper levers and a second adjusting unit connected to said lower lever.

6. The longitudinal folding apparatus of claim 5, wherein each of said first and second adjusting units has a drive shaft, said apparatus further comprising an external drive drive-connecting said drive shafts of said first and second adjusting units.

7. The longitudinal folding apparatus of claim 5, wherein said first and second adjusting units each comprise a drive shaft, said apparatus further comprising first and second electric motors respectively connected to said drive shafts of said first and second adjusting units, said first and second electric motors being synchronously operable.

8. The longitudinal folding apparatus of claim 4, wherein said former roll is rotatably mounted on said folding former.

9. The longitudinal folding apparatus of claim 8, wherein a cover of said former roll is tangent on a plane which includes a web bearing face of said folding former.

10. The longitudinal folding apparatus of claim 4, wherein said levers are configured such that a pivoting movement of said levers causes a maximized adjustment movement of said folding former in the direction parallel to said longitudinal axes and a minimized adjustment movement of said folding former in a vertical direction.

* * * * *